US007467533B2

(12) United States Patent
Badiou

(10) Patent No.: US 7,467,533 B2
(45) Date of Patent: Dec. 23, 2008

(54) METHOD AND APPARATUS FOR RAPIDLY CHANGING A WORKING ROLL OF A ROLL STAND

(75) Inventor: Jean-Claude Badiou, Veauche (FR)

(73) Assignee: Siemens Vai Metals Technologies SAS, Saint-Chamond (FR)

( * ) Notice: Subject to any disclaimer, the term of this patent is extended or adjusted under 35 U.S.C. 154(b) by 42 days.

(21) Appl. No.: 11/649,371

(22) Filed: Jan. 4, 2007

(65) Prior Publication Data

US 2007/0186611 A1 Aug. 16, 2007

(30) Foreign Application Priority Data

Jan. 4, 2006 (FR) ..... 06 50031

(51) Int. Cl.
*B21B 31/08* (2006.01)

(52) U.S. Cl. ..... 72/239; 72/238

(58) Field of Classification Search ..... 72/237, 72/238, 239

See application file for complete search history.

(56) References Cited

FOREIGN PATENT DOCUMENTS

DE 1752580 A1 8/1971

EP 0618018 A 10/1994

JP 57064406 A * 4/1982

* cited by examiner

*Primary Examiner*—Derris H Banks
*Assistant Examiner*—Debra M Wolfe
(74) *Attorney, Agent, or Firm*—Arent Fox LLP

(57) ABSTRACT

Method for changing working rolls of a roll stand provided with a roll displacement device located on the first side of the stand moving a roll along a loading axis (C, C'). Each has fastening means at a first end towards the first side and matching fastening means at a second end towards the second side of the stand opposite to the first side. Matching fastening means are on the displacement device. The substitute roll can be placed on either side of the stand. The displacement device operates by pulling when the substitute roll is on the second side simultaneously extracting the roll to be replaced towards the first side and loading the substitute roll from the second side; and, vice versa, by pushing when the substitute roll is on the first side of the stand.

The various fastening means and matching fastening means are respectively coupled and decoupled.

22 Claims, 8 Drawing Sheets

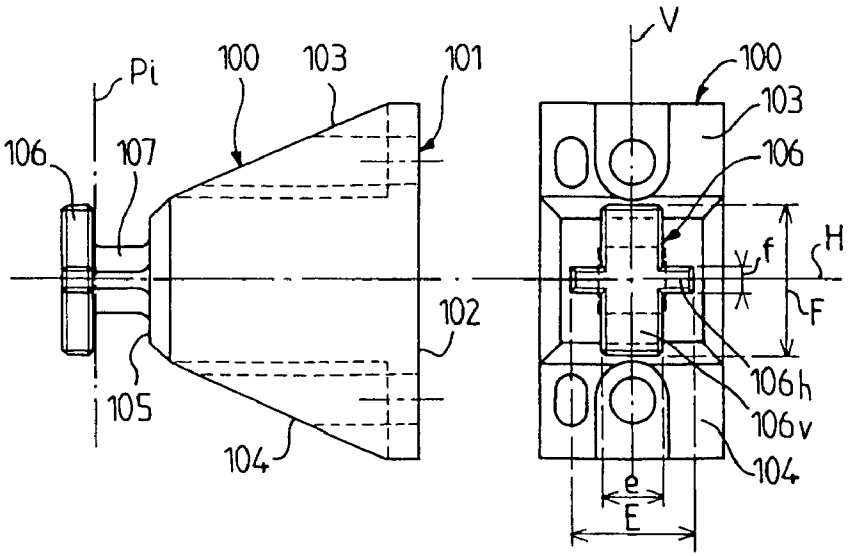
FIG.5A
FIG.5C
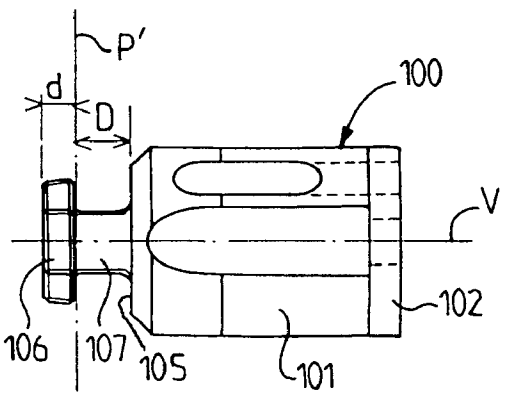
FIG.5B
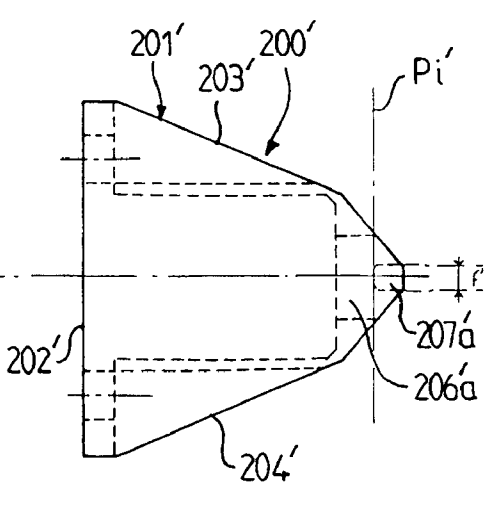
FIG.6A
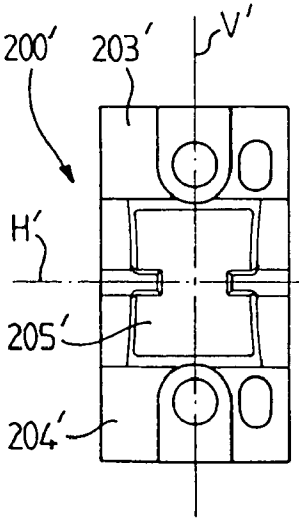
FIG.6C
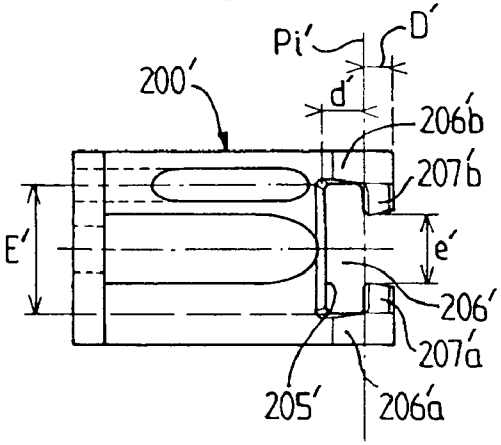
FIG.6B
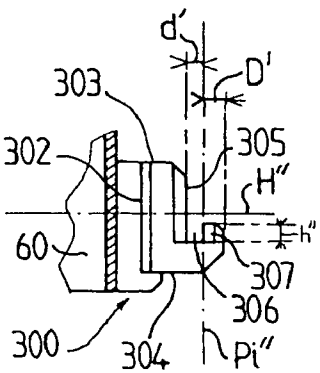
FIG.7

METHOD AND APPARATUS FOR RAPIDLY CHANGING A WORKING ROLL OF A ROLL STAND

CROSS-REFERENCE TO RELATED APPLICATION

This non-provisional application claims priority of Application Number 06 50031, filed Jan. 4, 2006, in France. The disclosure of the prior application is hereby incorporated herein in its entirety by reference.

BACKGROUND OF THE INVENTION

1. Field of the Invention

The invention relates to the field of the methods for changing rolls in a roll stand, and to that of rolling installations implementing such methods.

2. Description of Related Art

When a working roll in a roll stand is worn or damaged, it must be changed. To do so, the rolling mill is stopped and the roll to be replaced is unloaded from the stand. It is then led towards a workshop dedicated to rolls for rectification purposes. Once the stand has been unloaded, a new roll is loaded into the empty stand and the operation of the rolling installation is resumed.

More particularly, the invention applies to rolling mills for which the working rolls are not directly driven into rotation, but by means of back-up rolls, which are driven into rotation by associated driving means, and drive in turn by friction the working rolls in contact with the product to be rolled. Such is the case for example in a "skin-pass" rolling mill intended for conferring to a band to be rolled a particular surface finish. Thus, for such rolling mills, the engine side of the roll stand (the side where the driving means are situated, in opposition to the operating side) is relatively clear, at least in the vicinity of the working rolls.

It is then possible to elect either an installation enabling to unload the worn rolls on the engine side, or an installation enabling to load new rolls from the engine side.

According to a first known method enabling to extract a worn roll from the stand while inserting a new roll inside the stand, the rolling installation is fitted with a pushing displacement device. The actuation of this device enables to push a new roll in order to load it inside the stand. The new roll pushes in turn the worn roll initially in the stand in order to unload it outside the stand.

Thus, the new roll is located initially, before being loaded in the stand, on a first side of the stand where the pushing device is situated, and the worn roll is received on a carriage arranged on the other side of the stand with respect to the pushing device.

It will be noted that the pushing device may be situated either on the engine side or on the operating side.

According to this first known method, the pushing device is a kind of simple piston which applies, by contact on one end of the new substitute roll, a pushing load directed along the axis of this new roll. The new roll is first moved, then brought in contact with one end of the worn roll to be replaced. In turn, the new roll applies a contact load to the worn roll, along the axis of this worn roll and capable of pushing the worn roll, in order to extract it outside the stand.

A shortcoming of this first method known lies in that it should be carried out very slowly so that, at any time, the rolls never acquire too great inertia which would render their movements uncontrollable. It is also necessary that the different contact reaction loads are perfectly aligned with the axis of the rolls so that the latter move axially along a loading direction of the stand. In the reverse case, the rolls, the bearings or the chocks wherewith the various rolls are fitted, or still other parts of the stand might be damaged.

According to a second known method, the rolling installation is fitted with a pull-type displacement device. Then one end of the worn roll in the stand has been fastened to one end of the new roll outside the stand, when the pulling device grips the other end of the worn roll to be replaced. The pulling device then applies a tensile load capable of moving the worn roll outside the stand. In turn, the worn roll drives by traction the new roll inside the stand. The worn roll extracted from the stand is received on a carriage arranged on the same side as the pulling device, whereas the new roll has been located previously, before being loaded in the cage, on the other side of the installation, opposite to the side where the pulling device is situated. It will be noted that one may elect to locate the pulling device either on the engine side or on the operating side.

According to this second known method, the fastening of the pulling device to one of the ends of the worn roll inside the stand, as well as the fastening of the other end of the worn roll to one of the ends of the new roll outside the stand, may be realised by co-operation between a hook and a ring. For instance, when the pulling device is fed towards the worn roll, the ring carried by the pulling device, by coming in contact with the hook, carried by the corresponding end of the worn roll, starts to be lifted by rotation around a pivot pin. Once the ring has cleared the tip of the hook, recall means lower it automatically inside the loop formed by the hook. Possibly, a collapsible finger is then actuated to close the hook around the ring and to prevent the latter from being dislodged. The rolls may then be moved by traction.

A difficulty of such known method lies in that after inserting new rolls in the stand, it is necessary to conduct a complex and time-consuming operation in order to disengage the hooks from the corresponding rings. Moreover, such operation is generally carried out manually by an operator.

SUMMARY OF THE INVENTION

However, it seems preferable to automate as far as possible the operations which should be conducted in the vicinity of the rolling mill. Indeed, the zone situated around the rolling mill, regardless whether on the engine side or on the operating side, remains a dangerous zone for the staff. It is therefore an object of the invention to develop installations offering increased safety for the people.

Moreover, another object of the invention is to limit the impact of the roll changing operations on productivity.

Still, according to the previous art, when changing the rolls, either the mill is stopped and the idle machine time corresponding involves loss of productivity, or the rolling mill continues to operate, and the band length which has been unwound during the changing of the rolls has not been rolled or at least has not been rolled according to the specifications required. This length of band not corresponding to a finished product is then impossible to sell and constitutes a loss in production.

When using rolling installations serving for the production of a large quantity of rolled products, i.e. of the order of 500,000 tons, a roll changing operation whereof the implementation is simpler and quicker remains attractive, even if the gains in productivity are then marginal.

Conversely, the question of gains in productivity is raised with greater emphasis for the operation of rolling installations enabling to realise fractional productions. By fractional or fragmented production, is meant the successive production of various rolled products, each product being produced in small quantities, for example smaller than 1000 tons. Recently, such new forms of implementing rolling installations have been adopted more and more by the industry.

This is typically the case for rolling installations producing special steels. Then, for each type of product to obtain, the rolling tool should be suited to the specifications required. In particular, the working rolls must be adapted. For instance, in a skin-pass installation, the roughness and the hardness of the rolls are selected relative to the surface condition requested. Thus, upon completion of the production with a relative small requested tonnage, the working rolls used are not necessarily worn and, therefore it is not necessary to send them towards the roll workshop for maintenance.

The invention therefore relates to a new method for rapid changing of working rolls, more particularly intended for installations enabling fractional productions. The invention also aims at providing an improved rolling installation adapted to the implementation of such method.

To this aim, the invention relates to a method for changing rapidly at least one working roll of a roll stand implementing a roll displacement device provided on a first side of the stand and capable of moving a roll according to the axis thereof, along a loading axis of the stand, for simultaneously extracting from the stand a roll to be replaced and loading in the stand a substitute roll.

According to the invention, the displacement device is of the push-pull type, and each roll is fitted by fastening means at a first end towards the first side of the stand and by matching fastening means at a second end towards the second side opposite to the first side, said displacement device being fitted with such matching fastening means, wherein the substitute roll may be placed on anyone of the two sides of the stand, respectively the first side and the second side, wherein the displacement device is actuated by pulling when the substitute roll is placed on the second side for simultaneously extracting the roll to be replaced towards the first side and loading the substitute roll from the second side after coupling the fastening means and the matching fastening means of the roll to be replaced, respectively with the matching fastening means of the displacement device and with the fastening means of the substitute roll, and wherein the displacement device is actuated by pushing when the substitute roll is placed on the first side of the stand, for simultaneously loading the substitute roll from the first side and extracting the roll to be replaced towards the second side, after coupling the fastening means and the matching fastening means of the substitute roll, respectively with the matching fastening means of the displacement device and with the fastening means of the roll to be replaced, the various fastening means and matching fastening means being decoupled from one another after displacement and the roll to be replaced then being in standby, close to the stand of the rolling mill, ready to be used as a substitute roll, for later change of rolls.

More particularly, the substitute roll being initially located between the displacement device and the stand, the matching fastening means of the displacement device are coupled with the fastening means of the substitute roll, the matching fastening means of the substitute roll are coupled with the fastening means of the roll to be replaced, and the displacement device is actuated in pushing mode in order to move the substitute roll from the first side towards the inside of the stand, the substitute roll then pushing in turn the roll to be replaced in order to unload it outside the stand towards the second side of the stand, and the matching fastening means of the displacement device are decoupled from the fastening means of the substitute roll in the stand and the matching fastening means of the substitute roll in the stand are decoupled from the fastening means of the roll to be replaced outside the stand, the roll to be replaced then being in standby on the second side of the stand.

Advantageously, the method for fastening the substitute roll to the displacement device comprises following steps:

feeding matching fastening means provided on the displacement device, along the loading axis until they are in a vertical insertion plane Pi of fastening means arranged on a first end of the substitute roll, the various fastening means and matching fastening means being decoupled from one another after displacement and the roll to be replaced then being in standby, close to the stand of the rolling mill, ready to be used as a substitute roll, for later change of rolls.

Preferably, the substitute roll, being initially located on said first side, between the displacement device and the stand, the matching fastening means of the displacement device are coupled with the fastening means of the substitute roll, the matching fastening means of the substitute roll are coupled with the fastening means of the roll to be replaced, and the displacement device is actuated in pushing mode in order to move the substitute roll from the first side towards the inside of the stand, the substitute roll then pushing in turn the roll to be replaced in order to unload it outside the stand towards the second side of the stand, and the matching fastening means of the displacement device are decoupled from the fastening means of the substitute roll in the stand and the matching fastening means of the substitute roll in the stand are decoupled from the fastening means of the roll to be replaced outside the stand, the roll to be replaced then being in standby on the second side of the stand.

In this case, the method for fastening the substitute roll to the displacement device preferably comprises following steps:

feeding matching fastening means provided on the displacement device, along the loading axis until they are in a vertical insertion plane Pi of fastening means arranged on a first end of the substitute roll, the matching fastening means of the displacement device and the fastening means of the substitute roll being in a same horizontal plane H;

positioning the substitute roll while moving it perpendicular to the loading axis until the axis of the substitute roll is aligned with the loading axis, the fastening means of the substitute roll being then inserted with the matching fastening means of the displacement device in order to obtain a relative coupled position wherein the displacement device and the substitute roll are coupled in translation along the loading axis.

Preferably still, the method for fastening the roll to be replaced to the substitute roll positioned on the first side, comprises following steps:

pushing the substitute roll along the loading axis until matching fastening means arranged on a second end of the substitute roll are situated in a vertical insertion plane Pi of fastening means arranged on a first end of the roll to be replaced, the matching fastening means eing vertical to fastening means in a decoupled position;

opening the stand so that, the roll to be replaced being moved gradually vertically downwards, the fastening means of the roll to be replaced are inserted with the matching fastening means of the substitute roll so that upon completed opening of the stand, the roll to be replaced then resting by its chocks on guiding means, the roll to be replaced and the substitute roll are coupled in translation along the loading axis.

Advantageously, the substitute roll being inside the stand, the de-coupling step consists in closing the stand, so that the substitute roll is moved gradually vertically upwards, and:

on the second side, the matching fastening means of the second end of the substitute roll are disconnected from fastening means of the first end of the roll to be replaced so that upon completing closing of the stand, the matching fastening means are situated in a vertical insertion plane Pi of the fastening means which are vertical to matching fastening means in a relative decoupled position and, on the first side, the fastening means of the first end of the substitute roll are disconnected from matching fastening means of the displacement device so that upon completing closing of the stand, the fastening means of the substitute roll are situated in a vertical insertion plane Pi" of the matching fastening means of the displacement device, the matching fastening means being vertical to fastening means of the substitute roll in a relative decoupled position.

Moreover, the substitute roll may be located initially on the second side of the stand. Then, the matching fastening means of the displacement device are coupled with the fastening means of the roll to be replaced and the matching fastening means of the roll to be replaced are coupled with the fastening means of substitute roll, the displacement device is actuated in pulling mode to tow the roll to be replaced outside of the stand towards said first side, said roll to be replaced then pulling in turn the substitute roll from the second side towards the inside of the stand, and the matching fastening means of the displacement device are decoupled from the fastening means of the roll to be replaced outside the stand, and the matching fastening means of the roll to be replaced outside the stand of the fastening means are decoupled from the substitute roll inside the stand, said roll to be replaced then being in standby on said first side of the stand.

Preferably, the method for coupling the roll to be replaced to the displacement device comprises following steps:

feeding the matching fastening means of the displacement device, along the loading axis until they are in a vertical insertion plane Pi, perpendicular to the loading axis, of the fastening means of the roll to be replaced, in decoupled position, opening the roll stand so that, the roll to be replaced being moved gradually vertically downwards, its fastening means are inserted with the matching fastening means of the displacement device so that, after opening the stand completely, the roll to be replaced then rests with its chocks on guiding means so that its axis coincides with the loading axis, the roll to be replaced and the displacement device being then coupled in translation along the loading axis.

Moreover, the method for coupling the roll to be replaced to the substitute roll located on the second side, comprises following steps:

locating the substitute roll along the loading axis until fastening means provided on said substitute roll are situated in a vertical insertion plane Pi, perpendicular to the loading axis, of the matching fastening means of the roll to be replaced, in decoupled position;

opening the roll stand so that, the roll to be replaced being moved gradually vertically downwards, its matching fastening means are inserted with the fastening means of the substitute roll so that once the stand has been opened completely, the roll to be replaced then resting with its chocks on guiding means so that its axis coincides with the loading axis, the roll to be replaced and the substitute roll are coupled in translation along the loading axis.

Preferably still, the substitute roll being inside the stand, the de-coupling step of the substitute roll and of the roll to be replaced consists in closing the stand, so that, the substitute roll being moved gradually vertically upwards, fastening means of the first end of the substitute roll are disconnected from matching fastening means of the second end of the roll to be replaced, by moving in a vertical insertion means, the fastening means of the substitute roll being situated vertical to matching fastening means of the roll to be replaced, in a relative decoupled position.

In the embodiment contemplated currently, the substitute roll is carried initially by a chassis of a loading carriage capable of moving in order to position the axis of said substitute roll on the loading direction of the stand and the roll to be replaced is unloaded so as to be accommodated in a chassis of an unloading carriage capable of moving in order to position the axis of said roll to be replaced outside the loading direction of the stand, said unloading carriage being able to play the part of said loading carriage during later changing of rolls.

Moreover, the axis of said substitute roll is placed on the loading axis of the stand by moving a loading carriage including a chassis carrying said substitute roll and the axis of said roll to be replaced is moved outside the loading axis of the stand by moving an unloading carriage including a chassis carrying said roll to be replaced, whereas said unloading carriage may play the part of said loading carriage during later changing of rolls.

Preferably, the rolls have been changed while the band to be rolled is still running.

Preferably still, two working rolls arranged on both sides of the band to be rolled are replaced simultaneously.

The invention also relates to a rolling facility for implementing the method according to the invention.

In a preferred embodiment, the installation comprises at least one stand fitted with a set of rolls whereof the axes are arranged substantially horizontally in a main vertical plane, said set including at least one roll to be replaced, and said installation includes:

on a first side of the installation relative to a rolling axis, a first carriage movable in order to position at least one first chassis in the main plane close to a first stanchion of the stand;

on a second side of the installation relative to the rolling axis, a second carriage movable in order to position at least one second chassis in the main plane close to a second stanchion of the stand;

a roll displacement device provided on the first side, enabling to translate a roll in the main plane along a substantially horizontal loading axis, said displacement device may operate in traction mode in order to unload the roll to be replaced outside the stand on the first chassis, the roll to be replaced coupled to a substitute roll pulling the latter from the second chassis towards the inside of the stand, or in pushing mode in order to load a substitute roll from the first chassis towards the inside of the stand, the substitute roll coupled to the roll to be replaced pushing the latter outside the stand on the second chassis, and the first and second ends of the roll to be replaced and of the substitute roll are fitted respectively with fastening means and matching fastening means which enable to couple, removably, in translation along the loading axis, the roll to be replaced and the substitute roll.

In a embodiment of the fastening means, the stand being such that, when opening, the roll in the stand is moved in the main plane vertically downwards and, when closing, the roll in the stand is moved in the main plane vertically upwards, the fastening means of a roll among the roll to be replaced and the substitute roll and the matching fastening means of the other roll authorize mutual coupling and de-coupling by relative vertical movement in a vertical medium plane parallel to the main plane and in a vertical insertion means perpendicular to the main plane, so that coupling and de-coupling may take place when opening the stand or when closing the stand.

Preferably still, the fastening means arranged on a first end of the rolls include at least one fastening member fitted with an insertion part arranged, in the vertical insertion means, at the end of a portion of axis perpendicular to the insertion plane, the dimension along a horizontal direction of the insertion part being greater than the corresponding dimension of the portion of axis; and, the matching fastening means arranged on the second end of the rolls include at least one matching fastening member fitted with a vertical through-recess whereof the side the furthest from the second end of the roll is closed partially by des studs protruding horizontally towards one another the insertion part being capable of inserting and sliding vertically along said recess, the portion of axis being capable of running between the studs, the horizontal distance between the studs being greater than the horizontal dimension of the portion of axis but smaller than the horizontal dimension of the insertion part, in order to define a relative position coupled in translation along the loading axis.

In an embodiment of the displacement device, the former includes matching fastening means capable of being coupled with the fastening means arranged on a first end of a roll among the substitute roll and the roll to be replaced.

Preferably still, the stand being such that, when opening, the roll in the stand is moved in the main plane vertically downwards and, when closing, the roll in the stand is moved in the main plane vertically upwards, the fastening means of a roll among the roll to be replaced and the substitute roll and the matching fastening means of the displacement device enable mutual coupling or de-coupling by relative vertical movement in a vertical medium plane parallel to the main plane and in a vertical insertion means, so that coupling and de-coupling may take place respectively when opening the stand and when closing the stand.

Most preferably, the fastening means of a roll among the roll to be replaced and the substitute roll and the matching fastening means of the displacement device enable mutual coupling or de-coupling by relative horizontal motion in a horizontal medium plane perpendicular to the main plane and in a vertical insertion means perpendicular to the main plane, so that coupling and de-coupling may take place when moving the substitute roll in order to position it on the loading axis or when moving the roll to be replaced in order to place it as a back-up outside the loading axis.

Preferably, the matching fastening means of the displacement device include a matching fastening member fitted with a horizontal groove open from the top arranged perpendicular to the loading axis and capable of receiving, by bringing the latter closer horizontally and vertically from above, the insertion part of a fastening member, the vertical dimension of the insertion part being greater than the corresponding vertical dimension of the portion of axis.

In the embodiment contemplated, the insertion part of the fastening member is in the form of a cross arranged in the vertical insertion means and includes a vertical arm and a horizontal arm.

Preferably, the set of rolls include a plurality of rolls to be replaced and in that the installation enables to replace said plurality of rolls to be replaced in a single step.

Preferably, the set of rolls include rolls which are not to be replaced, and in that only said rolls which are not to be replaced may be directly driven into rotation by appropriate driving means.

Preferably, the installation is of the "skin-pass>> type.

BRIEF DESCRIPTION OF THE DRAWINGS

Other aims, details, characteristics and advantages of the invention will appear in the following description of particular embodiments given solely by way of non-limiting example, with reference to the appended drawings, whereon:

FIGS. 5A-C are views of a fastening member fitting the chocks facing towards the first side of the installation;

FIGS. 6A-C are views of a matching fastening member fitting the chocks facing towards the second side of the installation;

FIG. 7 is a lateral view, in the main plane of the installation, of a matching fastening member fitting the displacement device of the rolls;

DETAILED DESCRIPTION OF THE INVENTION

Figure 1:
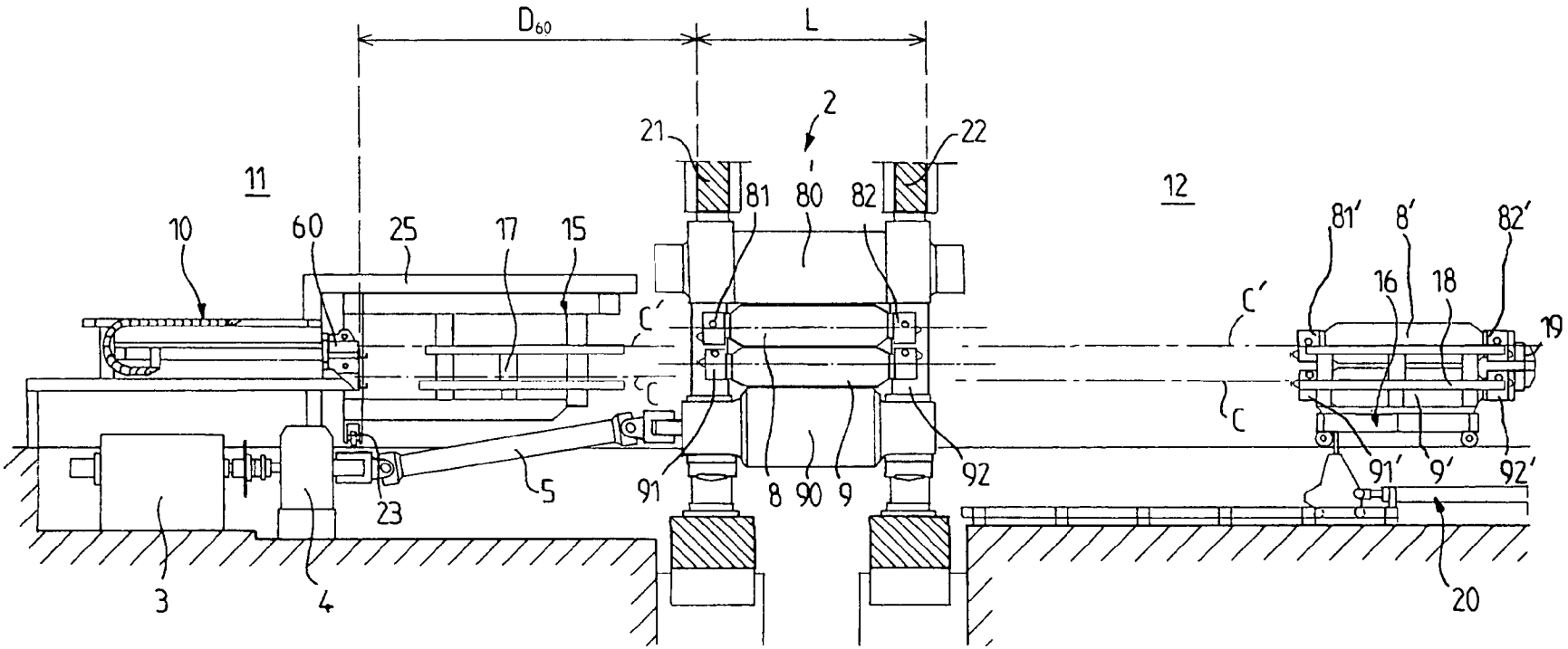
FIG. 1 is a general lateral view, in a so-called main plane, of the installation according to the invention.
Figure 2:
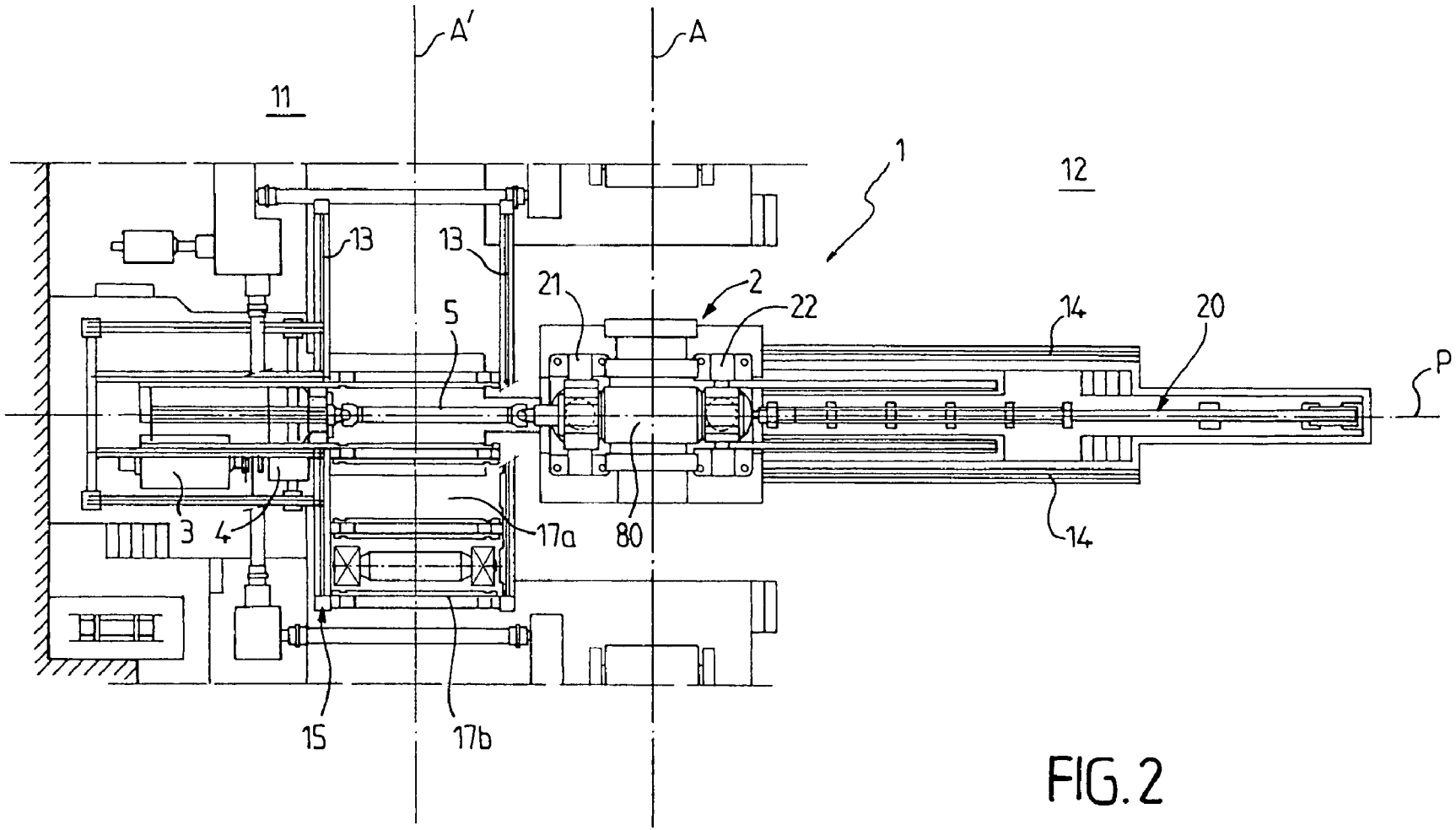
FIG. 2 is a general top view of the installation of FIG. 1

FIGS. 1 and 2 are overviews of a rolling installation in a preferred embodiment of the invention. The rolling installation 1 enables to roll a band running horizontally along a rolling axis A, between the working rolls of at least one roll stand 2 including a set of rolls.

The set of rolls is formed of a plurality of superposed rolls whereof the axes are arranged horizontally in a vertical main plane P perpendicular to the rolling axis A. FIG. 1 is a view of the installation in the main plane P. The rolling axis A is hence perpendicular to the plane of FIG. 1.

The set of rolls in the stand comprises a lower back-up roll 90, a lower working roll 9, an upper working roll 8 and an upper back-up roll 80.

Some of the rolls are driven into rotation around the axis thereof thanks to driving means including an engine 3, a reducing gear 4 and an extension 5 coupled to the rolls to be driven.

The rolling installation 1 is divided, on both sides of the rolling axis A, between an engine side 11, where are situated the driving means of the rolls of the stand 2, and an operator side 12, arranged of the other side of the stand 2 and intended for authorizing access to the stand 2 to technicians entrusted with the maintenance and the handling.

To solve the problems mentioned in the introduction, and more particularly in the case of a rolling installation enabling to realise successively various productions in small quantities, the general principle of the invention rests on the use of a push/pull displacement device enabling, according to the selection made by the operator, either to push or to pull a train of rolls constituted of a roll to be replaced coupled to a substitute roll. The rolls extracted from the stand being placed as a back-up for being used during a later roll replacing cycle.

On the engine side 11 (left part of FIG. 1), a push/pull displacement device 10 is represented in a standby position. As a variation, the displacement device might be situated on the operator side 12 instead of the engine side 11. Consequently, it will be below referred to as first side and second side. The first side of the stand 2 corresponds to the side whereon is arranged the displacement device. Conversely, the second side will be the side of the stand 2 opposite to the first side. On the drawings, the first side is the engine side 11 and the second side is the operator side 12. Generally speaking, an element facing or arranged on the first side will be referred to as "first", whereas an element facing towards or arranged on the second side will be referred to as "second".

In order to implement the general principle of the invention, the installation gives the possibility to place a substitute roll on the engine side, between the displacement device and the stand when in pushing mode, and to remove the roll to be replaced from the engine side when in pulling mode. Such space requirements are for instance satisfied in rolling installations for which the working rolls are not directly driven. Indeed, at least at the level of the working rolls, the engine side of the installation is clear. A rolling installation of the "skin-pass" type is a particular example of a type of installation meeting these space requirements of the engine side 11. Indeed, in the "skin-pass" installations, the driving means are coupled to the lower back-up roll which, in turn, drives into rotation the lower working roll. It is such an installation which is represented on FIGS. 1 and 2. The extension 5 is coupled, by appropriate means, to the lower back-up rolls 90.

In a standby position of the displacement device 10, the head 60 of the displacement device 10 is situated at a distance $D_{60}$ of the first stanchion 21 of the stand 2, which corresponds essentially to the width L of the rolls and enables maneuvering the rolls between the first stanchion 21 and the head 60 of the displacement device 10.

The aim of the method according to the invention is hence rapid changing of the set of working rolls to be replaced 8 and 9, situated inside the stand, with a set of substitute working rolls 8' and 9', situated outside the stand. Although the method may be adapted for replacing in succession each working roll, it is preferable to realise the changing of both lower and upper working rolls in a single step.

On FIG. 1, the substitute rolls 8' and 9' are brought onto the second side 12 of the rolling installation 1. They are transported on a second carriage 16 capable of moving perpendicular to the rolling axis A, along a second pair of rails 14. The second carriage 16 is fitted with a second chassis 18 receiving the lower and upper substitute rolls 8' and 9' in a relative position corresponding substantially to the one they should adopt once inserted in the stand of the rolling mill 2.

The second carriage 16 is moved, thanks to translation means 20, between a position spaced apart from the second stanchion 22 of the stand 2 and a position close to said second stanchion 22. The spaced apart position is such that the operator side is clear and enables access to the stand 2 for the operators.

On the first side 11, the rolling installation 1 includes a first pair of rails 13 along which a first carriage 15 may be moved. The first carriage 15 moves, at least in the vicinity of the first stanchion 21, along a displacement direction A' parallel to the rolling axis A. As represented on FIG. 2, the first carriage 15 includes two first chassis 17*a* and 17*b* capable of receiving a set of working rolls. On FIG. 2, one of the first chassis, here the first chassis 17*a*, is occupied by a set of substitute rolls serving as back-up rolls, whereas the other first chassis 17*b* is empty.

Incidentally, FIG. 1 shows the particular shape of the first carriage 15 which is of the hanging type. The first rails 13 along which circulates the first carriage 15, are arranged on a frame 25 at a raised level with respect to the level of the ground of the installation. Consequently, the first carriage 15 may circulate above a pitch provided in the ground in order to accommodate the driving means therein.

During the replacement operation, the rolls to be replaced 8 and 9 and the substitute rolls 8' and 9' are moved along a loading direction. More particularly, the lower rolls 9 and 9' are moved along a lower horizontal loading direction C and the upper rolls 8 and 8' are moved along an upper horizontal loading direction C'. The lower and upper loading directions C and C' lie in the main plane P.

Moreover, the rolls to be replaced and the substitute rolls have to be fitted with chocks. For example, the lower roll to be replaced 9 includes a first chock 91, fitting the end facing towards the first side of the installation, and a second chock 92 fitting the end facing towards the second side of the installation. Similarly, the upper roll to be replaced 8 and the lower 9' and upper 8' substitute rolls include firsts chocks 81, 81', 91' and seconds chocks 82, 82', 92'.

Figure 3:
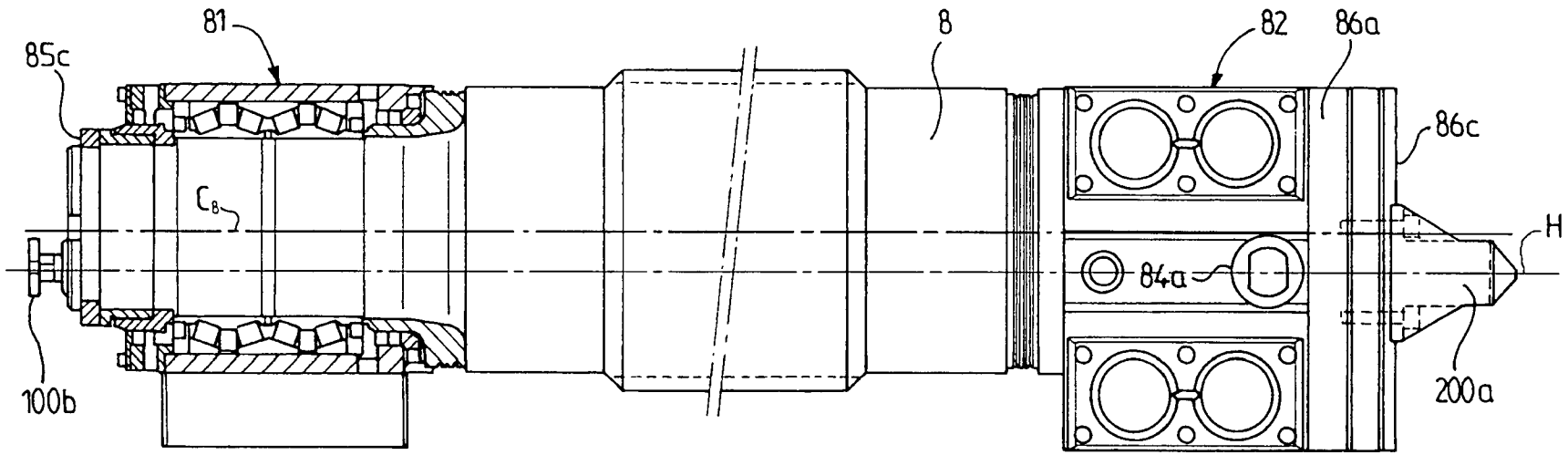
FIG. 3 is an axial view of a roll fitted with chocks used in the installation of FIGS. 1 and 2.
Figure 4:
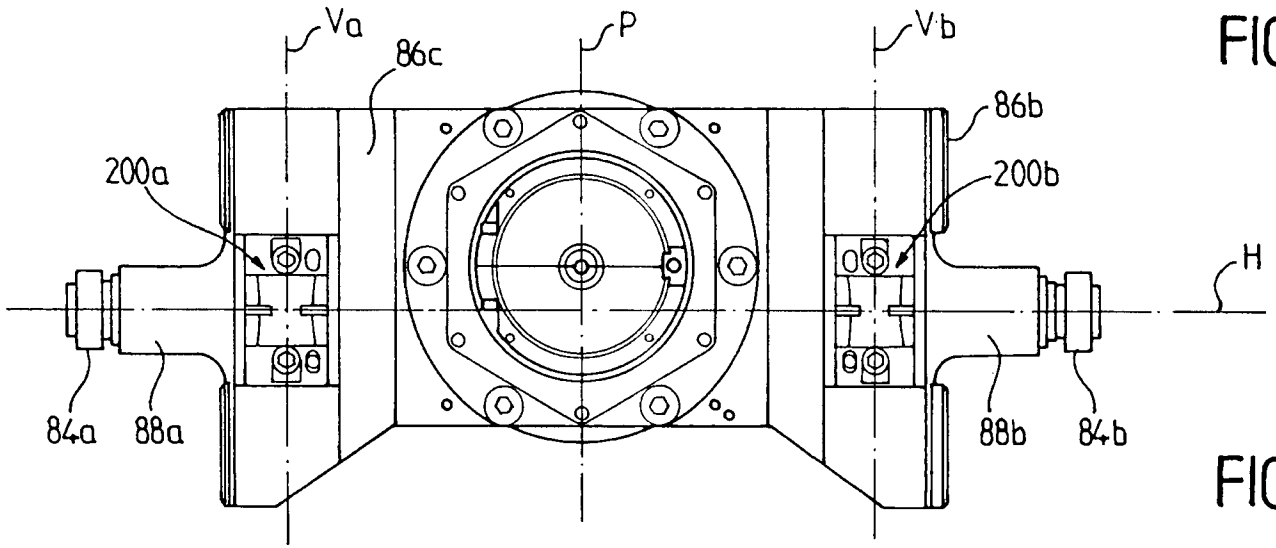
FIG. 4 is a cross-sectional view of the roll fitted with chocks of FIG. 3.

FIG. 3 is an axial view of one of the working rolls, for instance the upper working roll to be replaced 8. FIG. 4 is a transversal view relative to the axis of the roll.

The chock 82 has globally a parallelepipedal shape and includes vertical lateral faces 86*a* and 86*b* arranged on both sides of the axis $C_8$ of the roll and an end vertical face 86*c* perpendicular to the axis of the roll $C_8$. Each of the lateral faces 86*a* and 86*b* carries a protruding cylindrical portion 88*a* and 88*b* whereon a roller 84*a* and 84*b* is mounted, free to rotate.

These rollers enable to change the assembly formed by a roll fitted with its chocks along guiding means so that it moves along the loading direction. More precisely, the guiding means are formed of rails arranged on the second chassis 18, rails arranged transversally between the stanchions of the stand 2 and rails arranged on the first chassis 17. When changing the rolls, the rails of the first chassis 17, the rails of the stand 2 and the rails of the second chassis 18 are aligned and form a continuous rolling path for the rollers of the chocks. Thus, a roll is capable of being moved, along this path, on the first side to the second side of the installation through the stand 2, or reversely.

The chocks used according to the invention can be differentiated from the chocks of the previous art in that they are fitted either with fastening means or with matching fastening means. More particularly, two fastening members 100*a* and 100*b* are positioned on the vertical face 85*c* of the first chock 81 and two matching fastening members 200*a* and 200*b* are arranged on the vertical face 86*c* of the second chock 82.

The matching fastening members 200 of a roll to be replaced are intended for co-operating with fastening members 100' of a substitute roll.

Similarly, the fastening members 100 of a roll to be replaced are intended for co-operating with matching fastening members 200' of a substitute roll.

Consequently, for a roll, the fastening member 100*a* (respectively 100*b*) and the matching fastening member 200*a* (respectively 200*b*) are centered in the same vertical medium plane Va (respectively Vb) parallel to the main plane P the fastening members 100*a* and 100*b* and the matching fastening members 200*a* and 200*b* are centered in the same horizontal medium plane H.

The particular shape of the fastening means 100 and of the matching fastening means 200 will now be described in detail with reference to FIGS. 5A-C and 6A-C.

FIGS. 5A, 5B and 5C represent a fastening member 100 respectively in the vertical medium plane V, in the horizontal medium plane H and in a vertical so-called insertion plane Pi perpendicular to the planes H and V. The vertical plane V and the horizontal plane H are planes of symmetry of the fastening member 100.

The fastening member 100 includes a base 101 having a parallelepipedal shape whereof the lateral faces parallel to the plane V are trapezoidal. The greater side of the trapezoid defines a bearing face 102, intended for bearing against the end vertical face 85*c* of the corresponding chock 81. The tilted sides of the trapezoid define upper 103 and lower 104 lateral faces of the fastening member 100. These lateral faces 103 and 104 are respectively drilled with a through-hole perpendicular to the bearing face 102, which are intended for receiving the axis of an attachment means of the fastening member 100 on the corresponding chock 81. Finally, the smaller side of the trapezoid defines a <<front>> face 105 parallel to the insertion plane Pi.

The front face 105, parallel to the plane Pi, carries a portion in the form of a cross 106, by dint of a square section of rod 107 protruding perpendicular to the front face 105.

In the insertion plane Pi (FIG. 5C), the cross-shaped section 106 includes a horizontal arm 106*h*, arranged in the horizontal medium plane H, and a vertical arm 106*v*, arranged in the vertical medium plane V. In the embodiment illustrated, the horizontal arm 106*h* has a width f and a length E, whereas the vertical arm 106*v* has a width e and a length F. It should be noted that the width e of the arm 106*v* corresponds substantially to the width of the rod 107. Besides, the thickness of the cross-shaped section 106 is marked d on FIG. 5B and the length of the section of rod 107 is marked D.

The faces of arms 106*v* and 106*h* facing the front face 105 define the insertion plane Pi of the fastening member 100. When the fastening member 100 is in position on the chock of a roll, the insertion plane Pi is perpendicular to the axis of the roll and will then be perpendicular to the loading axis during the replacement steps of the rolls.

The matching fastening member 200' represented on FIGS. 6A, 6B and 6C is intended for co-operating with the fastening member 100 which has just been described. The matching fastening member 200' is symmetrical with respect to the vertical medium plane V' (plane of FIG. 6A) and with respect to the horizontal medium plane H' (plane of FIG. 6B). The plane of FIG. 6C is a so-called matching insertion vertical plane Pi', perpendicular to the planes V' and H'.

The matching fastening member 200' includes a base 201 having a parallelepipedal shape whereof the lateral faces parallel to the plane V' have a trapezoidal shape. The greater side of the trapezoid defines a bearing face 202', intended for abutting against the vertical end face 86'*c* of the second chock 82' whereon the matching fastening member 200' is mounted. The tilted sides of the trapezoid define upper 203' and lower 204' tilted faces. The tilted faces include respectively through-holes emerging at right angle on the bearing face 202' and which are intended for receiving attachment means of the matching fastening member 200' on the corresponding chock 82'. Finally, the smaller side of the trapezoid defines a <<front>> face 205', parallel to the matching insertion plane Pi'. The front face 205' defines the bottom of a recess 206'. As indicated on FIG. 6B, the recess 206 is limited laterally, if moving away from the vertical plane V while remaining on the horizontal plane H, by walls 206'*a* and 206'*b* which extend the vertical trapezoidal lateral faces of the base 201'. The wall 206'*a* (respectively 206'*b*), having a globally triangular shape, carries, at its furthest apex from the base 201', a parallelepipedal stud 207'*a* (respectively 207'*b*) protruding horizontally towards the vertical plane of symmetry V'.

The studs 207'*a* and 207'*b* having a thickness f', are opposite to one another and are spaced apart by a distance e'. The faces of the studs 207'*a* and 207'*b* facing the bottom 205' of the recess 206' define the insertion plane Pi' of the matching fastening member 200'. The distance d', between the insertion plane $P'_i$ and the bottom 205', defines the thickness of the recess 206' whereof the width is marked E'. The thickness of the studs 207'*a* and 207'*b* is marked D'. Once the matching fastening member 200' in position on the chock of a roll, the matching insertion plane Pi' is perpendicular to the axis of this roll and will also be perpendicular to the loading axis during the replacement steps of the rolls.

For providing cooperation of the fastening member 100 with the matching fastening member 200', the dimensions of the cross-shaped section 106 and of the rod 107, on the one hand, and of the recess 206' and studs 207'*a* and 207'*b*, on the other hand, are adapted. Thus the following relations are obtained: $e \lessapprox e'$; $d \lessapprox d'$; $D' < D$; $e' < E \lessapprox E'$; $f = f'$.

FIG. 7 represents a matching fastening member 300 fitting the head 60 of the displacement device 10. The matching fastening member 300 is intended for co-operating with a fastening member 100 or 100' provided on a first chock of the roll to be replaced or of the substitute roll facing the displacement device 10. The fastening member constitutes an embodiment variation of the matching fastening member 200, which enables coupling by vertical approach and by horizontal approach as will now be described.

FIG. 7 represents the matching fastening member 300 in a vertical plane V" of symmetry. Besides, a horizontal plane H" has been represented, but it does not constitute a plane of symmetry of the member 300. Finally, a vertical so-called insertion plane Pi" is arranged perpendicular to the planes V" and H".

The matching fastening member 300 includes a parallelepipedal base including a bearing face 302 intended for facing a supporting part arranged on the head 60, two lateral upper and lower faces 303 and 304 and a <<front>> face 305 parallel to the insertion plane Pi". The lower wall 304 extends and protrudes beyond the front face 305. It forms a wall terminated by a rim 307 at right angle facing upwards towards the plane H". Thus, the matching fastening member 300 is fitted with a groove 306 of width d" and of height h". The rim 307 is of thickness D" and of width E" in the insertion plane Pi". The width E" is substantially equal to the width of the base of the member 300.

So that the fastening member 100 and the matching fastening member 300 co-operate, the dimensions of the cross-shaped section 106 and of the rod 107, on the one hand, and of the groove 306 and of the rim 307, on the other hand, are adapted. Thus, the following relations can be obtained: $d \lessapprox d''$; $D'' \leqq D$; $e < E''$; $f \approx f'$; $h'' < (F-e)/2$.

Figures 8A, 8B:
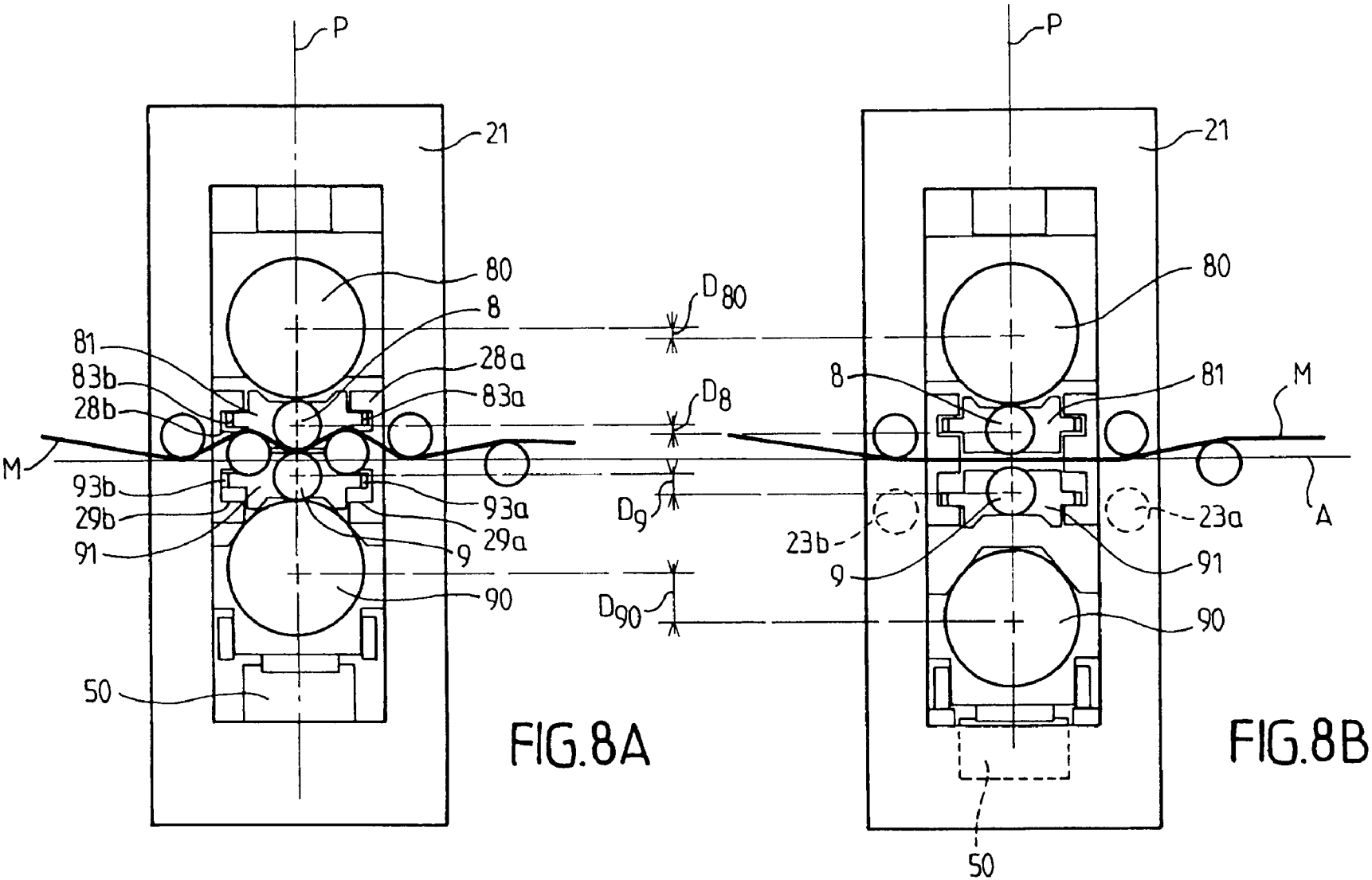
FIGS. 8A and 8B represent respectively, in lateral view, a stand in closed position and in open position.

FIGS. 8A and 8B represent the stand 2, respectively in closed position and in open position. On FIG. 8A, the stand 2 is closed and a piston 50 lifts the lower bearing roll 90. The latter lifts in turn the lower 9 and upper 8 working rolls until the generatrix of the upper working roll 8 brings in contact with the generatrix of the upper bearing roll 80. It should be noted that, in this closed position, the rollers 83*a*, 83*b*, 93*a* and 93*b* of the chocks 81 and 91, as well as the rollers 84*a*, 84*b*, 94*a* and 94*b* of the chocks 82 and 92 (non represented on FIG. 8), are not in contact with the guiding rails of the stand 28*a*, 28*b*, 29*a* and 29*b*.

On FIG. 8B, the stand is open. The piston 50 has been lowered so that the lower bearing roll 90 descends, in the main plane P, over a distance $D_{90}$. The lower working roll 9, which is not supported any longer by the lower bearing roll 90, moves vertically in the main plane P over a distance $D_9$. The downwards movement of the working roll 9 ends once the rollers of the chocks of this roll come in contact with the guiding rails 29*a* and 29*b*. Similarly, the upper working roll 8 descends in the main plane P over a distance $D_8$. The downwards movement of the upper working roll 8 is limited once the rollers of the chocks of this roll come in contact with the guiding rails 28*a* and 28*b*. Finally, the upper bearing roll 80 remains almost on the same level.

It will be noted that once the stand is open, additional deflecting rolls 23*a* and 23*b* for guiding the band M are spaced apart from the main plane P so that the band runs in a horizontal medium plane containing the rolling axis A. The working rolls 8 and 9 are held at a distance from the band so that the changing of the rolls may take place whereas the band M is engaged in the stand 2.

Thus, when opening and closing the stand, the working rolls have a vertical movement over a predetermined amplitude. The downwards movement is used for coupling the rolls to be replaced 8, 9 in the stand, either to the substitute rolls 8', 9' in pushing mode, or to the substitute rolls and to the displacement device 10 in pulling mode. The upwards movement is used for de-coupling the substitute rolls 8', 9' in the stand either from the displacement device 10 and from the rolls to be replaced 8, 9 in pushing mode, or from the rolls to be replaced 8, 9 in pulling mode.

This coupling/de-coupling operation will now be described with reference to FIGS. 9A to 9F.

Figure 9A:
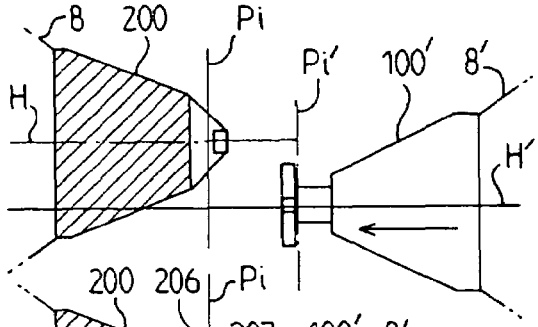
FIGS. 9A-F represent schematically different elementary steps for fastening, then releasing a roll to be replaced and a substitute roll.

FIG. 9A represents a roll to be replaced 8, in the stand, whereof the second end, facing towards the second side 12, is fitted with a matching fastening member 200. A standby substitute roll 8' has also been represented on the second side of the installation. The first end of the substitute roll 8', facing towards the first side 11, is fitted with a fastening member 100'.

The coupling step of the rolls takes place once the axis of the substitute roll 8' has been aligned with the loading direction C'. The vertical medium planes V' of the fastening member 100' and V of the matching fastening member 200 are then superimposed.

Figure 9B:
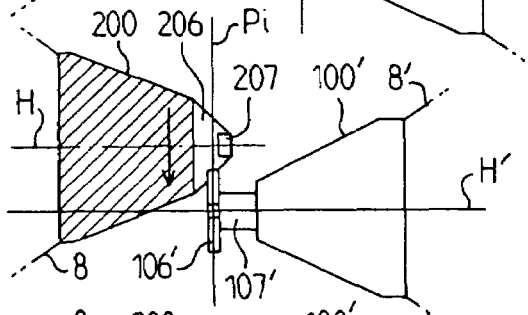

The substitute roll 8' is then brought closer to the second stanchion 22 of the stand 2 until the insertion plane Pi' of the fastening member 100' coincides with the insertion plane Pi of the matching fastening member 200. At this stage, the cross-shaped section 106' of the member 100' lies exactly below, at right angle, the recess 206 of the matching member 200 (FIG. 9B).

The stand 2 is then open, so that the roll to be replaced 8 descends along the main plane P. Simultaneously, the matching fastening member 200 descends along the vertical planes V'(=V) and Pi'(=Pi), until the horizontal medium planes H and H' of the members 100' and 200 coincide. Such coincidence can be obtained after opening the stand, since the guiding rails of the stand are aligned with the guiding rails of the second chassis 18.

Figure 9C:
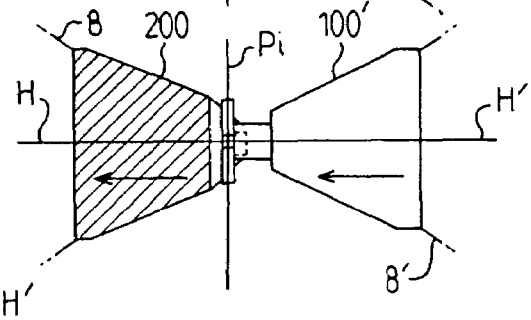

As represented on FIG. 9C, the studs 207 are in contact with the rear face of the horizontal arm 106'*h*, on both sides of the rod 107'. The roll to be replaced 8 and the substitute roll 8' are then in a relative coupled position and may be moved integrally in translation along the loading axis C'.

As indicated by the arrows represented on FIG. 9C, the roll to be replaced 8 is extracted in pulling mode by the displacement device 10 and drives therewith the substitute roll 8' which is thus inserted in the stand 2.

Figure 9D:
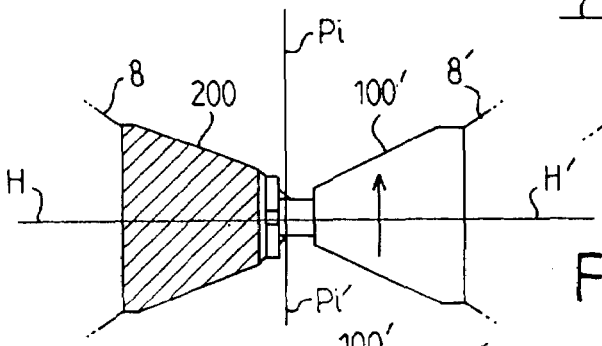
Figure 9E:
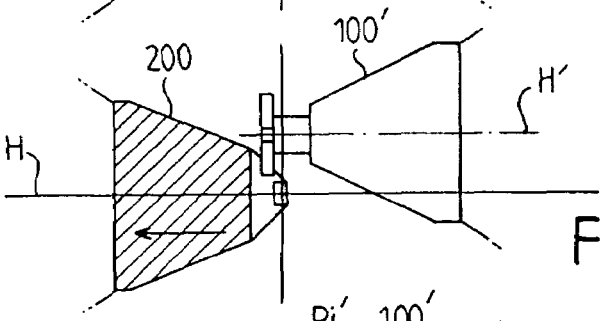
Figure 9F:
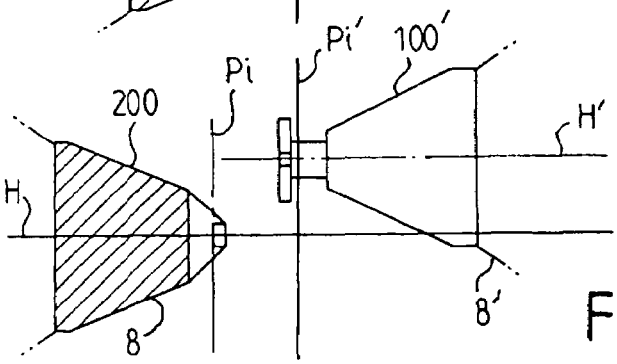

FIGS. 9D, 9E and 9F represent the de-coupling of the fastening means 100' and 200 once the roll to be replaced 8 is extracted totally and the substitute roll 8' is inserted correctly in the stand 2. The stand is then closed, so that the substitute roll 8' is lifted in the main plane P. The fastening member 100 is moved vertically upwards, while keeping the coincidence of the vertical medium planes V and V' and of the insertion planes Pi and Pi' of the fastening member 100' and of the matching fastening member 200. The horizontal plane of symmetry H' comes outside the horizontal plane of symmetry H. Consequently, the cross-shaped section 106' moves in the recess 206 and goes from the coupled position to a de-coupled position. In the de-coupled position, the lower section of the horizontal arm 106'*h* lies, relative to a horizontal level line, above the studs 207*a* and *b*, so that there is no coupling any longer along the loading axis between the rolls.

Finally, on FIG. 9F, the roll to be replaced 8 is spaced apart from the first stanchion 21 of the stand for being located as a back-up close to the stand.

An equivalent description could be provided, while reading FIG. 9 starting from FIG. 9F and going up towards FIG. 9A, to illustrate the case when the substitute roll is initially positioned on the first side of the installation and the displacement device operates in pushing mode.

It will be noted that coupling/de-coupling has been described by vertical approach of the fastening member 100' relative to the matching fastening member 200, such vertical approach taking place either above or below.

The coupling of a fastening member 100 with the matching fastening member 300 of the displacement device 10 will now be described. The matching fastening member 300 enables coupling/de-coupling either by vertical approach from the top of the fastening member 100 or by horizontal approach. Indeed, once the displacement device 10 has been used in pulling mode, the fastening member 100 of the roll to be replaced in the stand may be coupled with the matching fastening member 300 by vertical approach from above when opening the stand, as what has been described above. The vertical planes of symmetry V and V" being confused, the displacement device is actuated so that the insertion plane Pi" of the matching fastening member 300 coincides with the insertion plane Pi of the fastening member 100. Then, when opening the stand, the lower section of the vertical arm 106*v* of the cross-shaped section 106 of the fastening member 100 descends and is received in the groove 306 of the matching fastening member 300. After opening the stand, the rear face of the lower section of the vertical arm 106*v* is in contact with the rear face of the rim 307, so that there is a coupling between the displacement device 10 and the roll to be replaced 8 according to the loading axis. A similar description could be made for the de-coupling of the matching fastening member 300 and of the fastening member 100 when closing the stand.

But one should also be able to couple a fastening member 100 of a substitute roll 8' to the matching fastening member 300 of the displacement device 10, before the changing of the rolls, once it is requested to push a substitute roll in the stand. One should also be able to de-couple the fastening member 100 of the roll to be replaced 8 and the matching fastening member 300, after the changing of the rolls, once the roll to be replaced has been extracted by traction outside the stand.

The shape of the matching fastening member 300 is studied for authorizing coupling and de-coupling by lateral approach of the coupling member 100 in the horizontal plane H". The installation is built so that the horizontal plane H of the fastening member 100 of a roll arranged in a first chassis 17 coinciding with the horizontal plane H" of the matching fastening member 300.

Thus, by suitable actuation of the displacement device 10, the insertion planes P'i of the fastening member 100' and Pi" of the matching fastening member 300 are brought in coincidence. Then the substitute roll 8' is moved along a direction parallel to the rolling direction A. The fastening member 100' is then moved in the horizontal plane H", and the lower section of the vertical arm 106'*v* is inserted and slides in the groove 306 up to a coupled position wherein the vertical plane of symmetry V' of the fastening member 100' coincides with the vertical plane of symmetry V" of the matching fastening member 300. There is then a coupling of the substitute roll 8' and of the displacement device according to the loading axis.

A similar description could be made for the de-coupling of the displacement device and of the roll to be replaced once it has been extracted from the stand.

FIG. 10 represent different steps of the use of the installation of FIGS. 1 and 2, the coupling between rolls or with the displacement device being conducted with the fastening means described previously. Only the upper working roll will be mentioned below, but it should be borne in mind that the installation enables simultaneously to replace the lower working roll 9. For instance, the head 60 includes as many groups of matching fastening members as rolls to be replaced simultaneously. Indeed, a group of members includes as many matching fastening members as there are fastening members on a chock.

Figure 10A:
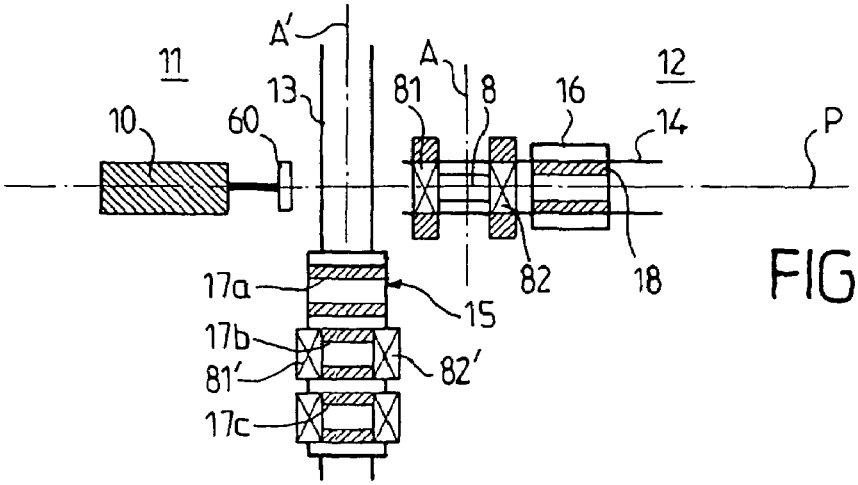
FIGS. 10A-E represent schematically different steps of the method for rapid changing of rolls; and, FIG. 11 represents an embodiment variation of the rolling installation according to the invention.

On FIG. 10A, the first carriage 15, including three first chassis 17*a*, 17*b* and 17*c*, is moved along the axis A' parallel to the rolling axis A, so that the first chassis 17*b* is positioned in the main plane P of the first side 11 of the installation, between the stand 2 and the displacement device 10. The first chassis 17*b* includes a substitute working roll 8' fitted with chocks. At this stage, the roll to be replaced 8 is in the stand. Finally, a second carriage 16 is arranged on the second side 12 of the installation. This second carriage 16 includes a second empty chassis 18 intended for receiving the roll to be replaced 8 when extracted from the stand 2.

When moving along the axis A' of the first carriage 15, the fastening members 100'*a* and 100'*b* arranged on the first chocks 81' of the substitute roll 8' are coupled to the matching fastening members 300*a* and 300*b* of the displacement device 10.

Figure 10B:
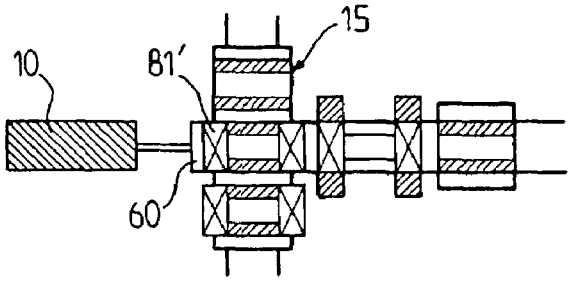

FIG. 10B represents the state of the installation once the substitute roll 8' is positioned in the main plane P and coupled to the displacement device 10.

Figure 10C:
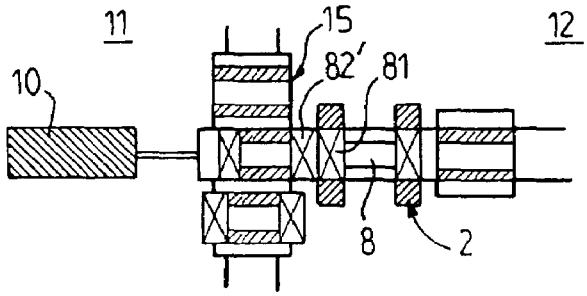

Then, the displacement device 10 is actuated to apply a pushing load to the substitute roll 8'. The latter starts moving along the loading axis outside the first carriage 17*b* until the insertion plane Pi' of the matching fastening members 200'*a* and 200'*b*, mounted on the second chock 82', coincides with the insertion plane Pi of the fastening members 100*a* and 100*b* mounted on the first chock 81 of the roll to be replaced 8 (FIG. 10C).

The stand 2 is then open, thus providing a coupling between the roll to be replaced 8 and the substitute roll 8' according to the loading axis.

Figure 10D:
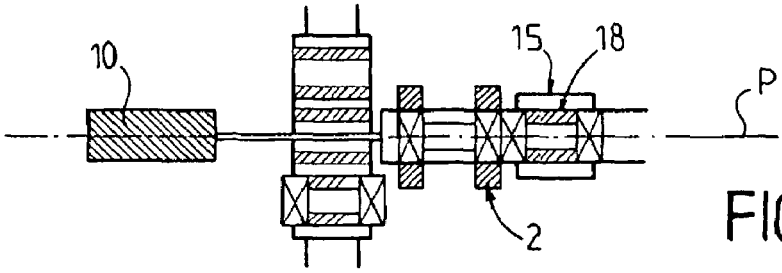

On FIG. 10D, the displacement device 10 is still actuated in pushing mode for extracting the roll to be replaced 8 of the stand 2 and for inserting therein the substitute roll 8'. This operation ends once the substitute roll 8' is correctly positioned in the stand 2, i.e. centered on the rolling axis A.

Finally, the stand 2 is closed, thus providing a de-coupling between the fastening members 100'*a* and 100'*b* and the matching fastening members 300*a* and 300*b*, on the first side 11, and between the matching fastening members 200'*a* and 200'*b* and the fastening members 100*a* and 100*b* of the second side 12.

Figure 10E:
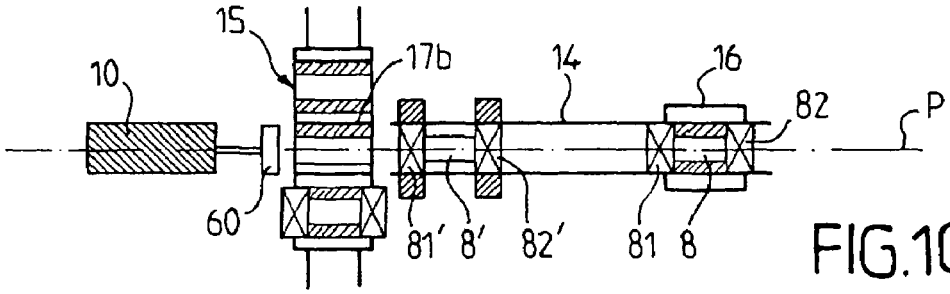

On FIG. 10E, the roll to be replaced 8 provided on the second chassis 18 of the second carriage 16 is located as a back-up, close to the stand 2. The displacement device 10 is for instance repositioned in its initial standby position.

Figure 11:
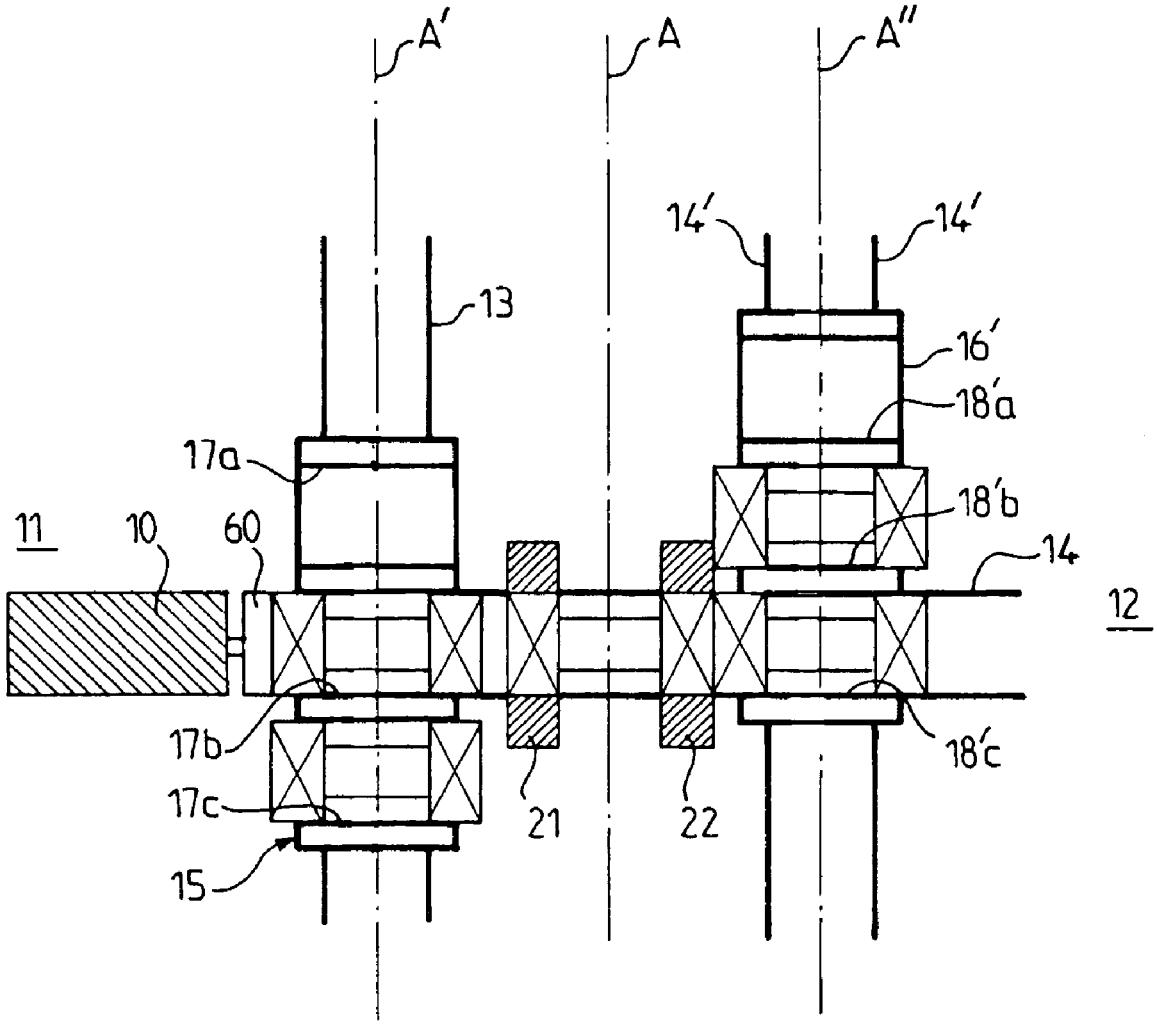

FIG. 11 represents a variation of the installation according to the invention wherein the first carriage 15 circulates along a first direction A' parallel to the rolling axis A and the second carriage 16' also moves according to a direction A" parallel to the rolling axis A. Each of the first and second carriages 15 and 16' include a plurality of chassis, in this instance three. Chassis are empty on both sides of the stand to enable the reception of the rolls to be replaced during possible operation in pulling mode or in pushing mode. The other chassis are occupied and carry rolls serving as back-up units intended for being inserted in the stand during a roll changing cycle to come, when changing next the nature of the production for instance.

Obviously, the first and second carriages may be moved up to the roll workshop if it is necessary to convey the rolls thereto for rectification purposes.

It appears therefore that the method according to the invention is particularly rapid, especially thanks to the presence of the fastening means which enable coupling of the different elements. This enables to control the displacement of the rolls along the loading axis and hence to proceed to quicker displacement of the rolls. Besides, the extracted rolls are placed as back-ups close to the roll stand and are immediately available in case of new change in production. The use of a displacement device enabling loading in pushing mode or in pulling mode according to a choice of the operator is also particularly advantageous. Finally, coupling and de-coupling operations take place automatically when opening and closing the stand while making use of the movement followed by the rolls in the stand during such opening or closing.

Although the invention has been described with reference to a particular embodiment, it is in no way limited thereto. It comprises all the technical equivalents of the means described as well as their combinations within the framework of the invention.

I claim:

1. A method for changing rapidly at least one working roll of a roll stand (2) implementing a roll displacement device (10) provided on a first side of the stand and capable of moving a roll according to the axis thereof, along a loading axis (C, C') of the stand, for simultaneously extracting from the stand a roll to be replaced (8, 9) and loading in the stand a substitute roll (8', 9'), wherein said displacement device is of the push-pull type, wherein each roll (8, 9, 8', 9') is fitted by fastening means (100) at a first end towards the first side of the stand and by matching fastening means (200) at a second end towards the second side opposite to the first side, said displacement device (10) being fitted with such matching fastening means (300), wherein the substitute roll (8', 9') may be placed on anyone of the two sides of the stand, respectively the first side and the second side, wherein the displacement device (10) is actuated by pulling when the substitute roll (8', 9') is placed on the second side for simultaneously extracting the roll to be replaced (8, 9) towards the first side and loading the substitute roll from the second side after coupling the fastening means (100) and the matching fastening means (200) of the roll to be replaced (8, 9), respectively with the matching fastening means (300) of the displacement device (10) and with the fastening means (100') of the substitute roll (8', 9'), and wherein the displacement device (10) is actuated by pushing when the substitute roll (8', 9') is placed on the first side of the stand, for simultaneously loading the substitute roll (8',9') from the first side and extracting the roll to be replaced (8, 9) towards the second side, after coupling the fastening means (100') and the matching fastening means (200') of the substitute roll (8', 9'), respectively with the matching fastening means (300) of the displacement device (10) and with the fastening means (100) of the roll to be replaced (8, 9), the various fastening means (100, 100') and matching fastening means (200, 200', 300) being decoupled from one another after displacement and the roll to be replaced (8, 9) then being in standby, close to the stand of the rolling mill, ready to be used as a substitute roll, for later change of rolls.

2. A method according to claim 1, characterised in that, the substitute roll (8', 9'), being initially located on said first side (11), between the displacement device and the stand, the matching fastening means (300) of the displacement device (10) are coupled with the fastening means (100') of the substitute roll (8, 9), the matching fastening means (200') of the substitute roll (8', 9') are coupled with the fastening means (100) of the roll to be replaced (8, 9), and the displacement device (10) is actuated in pushing mode in order to move the substitute roll (8', 9') from the first side (11) towards the inside of the stand, the substitute roll (8', 9') then pushing in turn the roll to be replaced (8, 9) in order to unload it outside the stand (2) towards the second side (12) of the stand, and the matching fastening means (300) of the displacement device (10) are decoupled from the fastening means (100') of the substitute roll (8', 9') in the stand and the matching fastening means (200') of the substitute roll (8', 9') in the stand are decoupled from the fastening means (100) of the roll to be replaced (8, 9) outside the stand, the roll to be replaced then being in standby on the second side of the stand.

3. A method according to claim 2, characterised in that, the method for fastening the substitute roll (8', 9') to the displacement device (10) comprises following steps:

feeding matching fastening means (300) provided on the displacement device (10), along the loading axis (C, C') until they are in a vertical insertion plane (Pi) of fastening means (100') arranged on a first end (81', 91') of the substitute roll (8', 9'), the matching fastening means (300) of the displacement device (10) and the fastening means (100') of the substitute roll (8', 9') being in a same horizontal plane (H);

positioning the substitute roll (8', 9') while moving it perpendicular to the loading axis until the axis of the substitute roll (8', 9') is aligned with the loading axis (C, C'), the fastening means (100') of the substitute roll (8',9') being then inserted with the matching fastening means (300) of the displacement device (10) in order to obtain a relative coupled position wherein the displacement device (10) and the substitute roll (8', 9') are coupled in translation along the loading axis (C, C').

4. A method according to any one of claims 2 or 3, characterised in that, the method for fastening the roll to be replaced (8, 9) to the substitute roll (8', 9') positioned on the first side (11), comprises following steps pushing the substitute roll (8', 9') along the loading axis (C, C') until matching fastening means (200') arranged on a second end (82', 92') of the substitute roll (8', 9') are situated in a vertical insertion plane (Pi) of fastening means (100) arranged on a first end (81, 91) of the roll to be replaced (8, 9), the matching fastening means (200') being vertical to fastening means (100) in a decoupled position;

opening the stand so that, the roll to be replaced (8, 9) being moved gradually vertically downwards, the fastening means (100) of the roll to be replaced (8, 9) are inserted with the matching fastening means (200') of the substitute roll (8', 9') so that upon completed opening of the stand, the roll to be replaced (8, 9) then resting by its chocks (81, 82 ; 91, 92) on guiding means, the roll to be replaced (8, 9) and the substitute roll (8', 9') are coupled in translation along the loading axis (C, C').

5. A method according to any one of claims 2 or 3, characterised in that, the substitute roll (8', 9') being inside the stand (2), the de-coupling step consists in closing the stand, so that the substitute roll (8', 9') is moved gradually vertically upwards, on the second side, the matching fastening means (200') of the second end (82', 92') of the substitute roll (8', 9') are disconnected from fastening means (100) of the first end (81, 91) of the roll to be replaced (8, 9) so that upon completing closing of the stand, the matching fastening means (200') are situated in a vertical insertion plane (Pi) of the fastening means (100) which are vertical to matching fastening means (200') in a relative decoupled position; and, on the first side, the fastening means (100') of the first end (81', 91') of the substitute roll (8', 9') are disconnected from matching fastening means (300) of the displacement device (10) so that upon completing closing of the stand, the fastening means (100') of the substitute roll (8', 9') are situated in a vertical insertion plane (Pi") of the matching fastening means (300) of the displacement device (10), the matching fastening means (300) being vertical to fastening means (100') of the substitute roll ((8', 9') in a relative decoupled position.

6. A method according to claim 1, characterised in that the substitute roll (8', 9') is located initially on the second side of the stand, the matching fastening means (300) of the displacement device (10) are coupled with the fastening means (100) of the roll to be replaced (8, 9) and the matching fastening means (200) of the roll to be replaced (8, 9) are coupled with the fastening means (100') of substitute roll (8', 9'), the displacement device (10) is actuated in pulling mode to tow the roll to be replaced (8, 9) outside of the stand towards said first side, said roll to be replaced (8, 9) then pulling in turn the substitute roll (8', 9') from the second side towards the inside of the stand, and the matching fastening means (300) of the displacement device (10) are decoupled from the fastening means (100) of the roll to be replaced (8, 9) outside the stand, and the matching fastening means (200) of the roll to be replaced (8, 9) outside the stand of the fastening means are decoupled from the substitute roll inside the stand, said roll to be replaced (8, 9) then being in standby on said first side of the stand.

7. A method according to claim 6, characterised in that the method for coupling the roll to be replaced (8, 9) to the displacement device (10) comprises following steps:

feeding the matching fastening means (300) of the displacement device (10), along the loading axis until they are in a vertical insertion plane (Pi), perpendicular to the loading axis, of the fastening means (100') of the roll to be replaced (8, 9), in decoupled position, opening the roll stand so that, the roll to be replaced (8, 9) being moved gradually vertically downwards, its fastening means (100) are inserted with the matching fastening means (300') of the displacement device (10) so that, after opening the stand completely, the roll to be replaced (8, 9) then rests with its chocks (81, 82; 91, 92) on guiding means so that its axis coincides with the loading axis, the roll to be replaced (8, 9) and the displacement device (10) being then coupled in translation along the loading axis (C, C').

8. A method according to any one of claims 6 or 7, characterised in that the method for coupling the roll to be replaced (8, 9) to the substitute roll (8', 9') located on the second side (11), comprises following steps:

locating the substitute roll (8', 9') along the loading axis (C, C') until fastening means (200') provided on said substitute roll (8', 9') are situated in a vertical insertion plane (Pi), perpendicular to the loading axis, of the matching fastening means (100) of the roll to be replaced (8, 9), in decoupled position opening the roll stand so that, the roll to be replaced (8, 9) being moved gradually vertically downwards, its matching fastening means (100) are inserted with the fastening means (200) of the substitute roll (8', 9') so that once the stand has been opened completely, the roll to be replaced (8, 9) then resting with its chocks (81, 82 ; 91, 92) on guiding means so that its axis coincides with the loading axis, the roll to be replaced (8, 9) and the substitute roll (8', 9') are coupled in translation along the loading axis (C, C').

9. A method according to any one of claims 6 or 7, characterised in that, the substitute roll (8', 9') being inside the stand (2), the de-coupling step of the substitute roll (8', 9') and of the roll to be replaced (8, 9) consists in closing the stand, so that, the substitute roll (8', 9') being moved gradually vertically upwards, fastening means (100') of the first end (81', 91') of the substitute roll (8', 9') become disconnected from matching fastening means (200) of the second end (82, 92) of the roll to be replaced (8, 9), so that, after closing the stand, the fastening means (100') of the substitute roll (8', 9') are located in a vertical insertion means (Pi"), the fastening means (100') of the substitute roll (8', 9') being situated vertical to matching fastening means (200) of the roll to be replaced (8, 9), in a relative decoupled position.

10. A method according to claim 9, characterised in that, the substitute roll (8', 9') being in the stand and decoupled from the roll to be replaced (8, 9), the decoupling step of the displacement device (10) of the roll to be replaced (8, 9) situated on the first side (11) consists in:

moving horizontally the roll to be replaced (8, 9) so that the axis of the roll to be replaced (8, 9) leaves the loading axis (8, 9) of the stand, the fastening means (100) of the roll to be replaced (8, 9) being disengaged laterally from the matching fastening means (300) of the displacement device (10), by moving horizontally in a vertical insertion plane (Pi), perpendicular to the loading axis, so that the displacement device (10) and the roll to be replaced (8, 9) are not coupled any longer in translation along the loading axis.

11. A method according to claim 1, characterised in that:

the axis of said substitute roll (8', 9') is placed on the loading axis (C, C') of the stand by moving a loading carriage (15 ; 16) including a chassis (17 ; 18) carrying said substitute roll; and, the axis of said roll to be replaced (8, 9) is moved outside the loading axis (C, C') of the stand by moving an unloading carriage (16; 15) including a chassis (18; 17) carrying said roll to be replaced (8, 9), whereas said unloading carriage may play the part of said loading carriage during later changing of rolls.

12. A method according to claim 10, characterised in that:

the axis of said substitute roll (8', 9') is placed on the loading axis (C, C') of the stand by moving a loading carriage (15; 16) including a chassis (17; 18) carrying said substitute roll; and, the axis of said roll to be replaced (8, 9) is moved outside the loading axis (C, C') of the stand by moving an unloading carriage (16; 15) including a chassis (18; 17) carrying said roll to be replaced (8, 9), whereas said unloading carriage may play the part of said loading carriage during later changing of rolls.

13. A method according to claim 11, characterised in that two working rolls (8, 8'; 9, 9') arranged on both sides of the band to be rolled are changed simultaneously.

14. A rolling installation including at least one stand (2) fitted with a set of rolls (80, 8, 9, 90) whereof the horizontal axes are situated in a main vertical plane (P), said set including at least one roll to be replaced (8, 9), and a displacement device of rolls (10) arranged on a first side (11) of the stand and enabling to translate a roll in the main plane along a loading axis (C, C') substantially horizontal, characterised in that said displacement device is of the pushing/pulling type, in that the rolls, regardless whether they are substitute rolls or rolls to be replaced, are respectively fitted at their end situated on the first side with fastening means (100, 100) and at their end situated on the second side opposite to the first side with matching fastening means (200, 200'), and in that said displacement device is fitted with matching fastening means (300), whereas the fastening means (100, 100') and matching fastening means (200, 200', 300) are capable of forming, removably, translation couplings along the loading axis (C, C') so that, when the displacement device (10) operates in pulling mode, it tows the roll to be replaced (8,9) outside the stand (2) towards the first side and said roll to be replaced (8, 9) tows in turn the substitute roll (8', 9') from the second side towards the inside of the stand, and, when the displacement device operates in pushing mode, it pushes the substitute roll (8', 9') from the first side inside the stand, and the substitute roll (8', 9') pushes the roll to be replaced (8, 9) outside the stand towards the second side.

15. An installation according to claim 14, characterised in that the stand (2) is such that, during the opening thereof, the roll in the stand is moved vertically, downwards, in the main plane (P) and, during the closing thereof, the roll in the stand is moved vertically, upwards, in the main plane (P), and in that the fastening means (100, 100') and the matching fastening means (200, 200') then authorize mutual coupling and decoupling by relative vertical displacement in a plane parallel to the main plane (P) and in a vertical insertion plane (Pi, Pi') perpendicular to the loading axis, so that coupling and decoupling may be realised respectively when opening and closing the stand (2).

16. An installation according to claim 15, characterised in that:

the fastening means arranged on a first end of each roll include at least one fastening member (100) fitted with an insertion part provided, in the vertical insertion plane (Pi), at the end of a portion of axis (107) perpendicular to the insertion plane, the dimension (E) along a horizontal direction of the insertion part being greater than the corresponding dimension (e) of said portion of axis, and, the matching fastening means provided on the second end of each roll include at least one matching fastening member (200') fitted with a vertical through-recess (206) whereof the side furthest from the second end of the roll is closed partially by toes (207'*a-b*) protruding horizontally towards one another;

whereas the insertion part (106) may be inserted and slide vertically along said recess (206'), the portion of axis (107) being capable of running between the toes (207'*a-b*), the horizontal distance (e) between the toes being greater than the horizontal dimension (e) of the portion of axis (107) but smaller than the horizontal dimension (E) of the insertion part (106), to define a relative position coupled in translation along the loading axis.

17. An installation according to any one of claims 14 to 16, characterised in that the fastening means (100, 100') of a roll among the rolls to be replaced (8, 9) and the substitute rolls (8', 9'), and the matching fastening means (300) of the displacement device (10) authorize mutual coupling and decoupling by relative displacement in a horizontal plane (H, H') and in a vertical insertion plane (Pi, Pi') perpendicular to the loading axis, so that the coupling may take place when moving the substitute roll (8', 9') in order to locate it on the loading axis (C, C') and the decoupling may take place when moving the roll to be replaced (8, 9) to put it in standby outside the loading axis (C, C').

18. An installation according to claim 17, characterised in that the matching fastening means of the displacement device (10) include a matching fastening member (300) fitted with a horizontal groove (306) open from the top arranged perpendicular to the loading axis (C, C') and capable of receiving the insertion part (106) of a fastening member (100), by bringing the latter closer horizontally and vertically from above, the vertical dimension (F) of the insertion part (106) being greater than the corresponding vertical dimension (f) of the portion of axis (107).

19. An installation according to claim 18, characterised in that said insertion part (106) of the fastening member (100) is in the form of a cross arranged in the vertical insertion means (Pi) and include a vertical arm (106*v*) and a horizontal arm (106*h*).

20. An installation according to claim 14, characterised in that said set of rolls include a plurality of rolls to be replaced (8, 9) and in that the installation enables to replace said plurality of rolls to be replaced in a single step.

21. An installation according to claim 14, characterised in that said set of rolls include rolls which are not to be replaced, and in that only said rolls which are not to be replaced may be directly driven into rotation by appropriate driving means (3, 4, 5).

22. An installation according to claim 21, characterised in that the installation is of the skin-pass type.

* * * * *